United States Patent [19]

Gazzara

[11] Patent Number: 4,574,767

[45] Date of Patent: Mar. 11, 1986

[54] BOW TRIGGER MECHANISM

[76] Inventor: Matthew R. Gazzara, 345 S. White Horse Pike, Hammonton, N.J. 08037

[21] Appl. No.: 595,465

[22] Filed: Mar. 30, 1984

[51] Int. Cl.[4] ..... F41C 19/00

[52] U.S. Cl. ..... 124/35 A

[58] Field of Search ..... 124/35 A

[56] References Cited

U.S. PATENT DOCUMENTS 3,948,243 4/1976 Gazzara ..... 124/35 A 4,257,386 3/1981 Gazzara ..... 124/35 A

*Primary Examiner*—Richard C. Pinkham

*Assistant Examiner*—Benjamin Layno

*Attorney, Agent, or Firm*—Steele, Gould & Fried

[57] ABSTRACT

A bow trigger mechanism is disclosed which includes a pair of spaced-apart frame members, the frame members defining an operating opening therewithin and terminating rearwardly in an integral handle featuring relatively wide bearing finger pulls. A pair of first and second bent jaws are pivotally retained within the spaced frame members and are movable between a normally closed and locked position to an open position wherein a clearance opening sufficient to allow passage of a bowstring is formed. A non-compressible, non-extendable spring is positioned in linear arrangement between the rearward extensions of the bent jaws and has its respective ends pivotally connected thereto. At least a major portion of the spring is exposed within the operating opening. By pulling rearwardly upon the spring within the clearance opening, the linear arrangement of the spring is transformed into an arcuate configuration, thereby causing the spring ends to move closer together to thus pull the rearward extensions of the jaws toward each other. The inward movement of the jaw extensions creates pivotal movement to open or close the jaw forward ends for bowstring loading, pulling and releasing purposes.

6 Claims, 5 Drawing Figures

FIG. 1
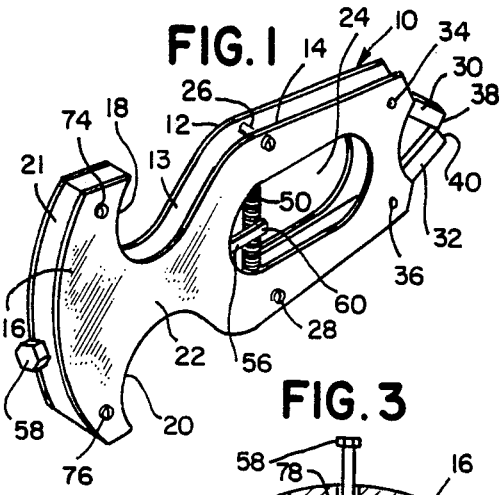
FIG. 2
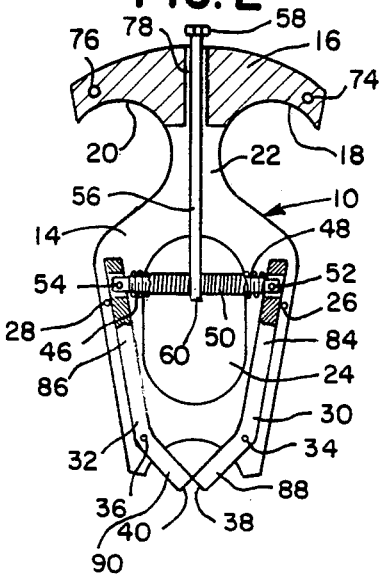
FIG. 3
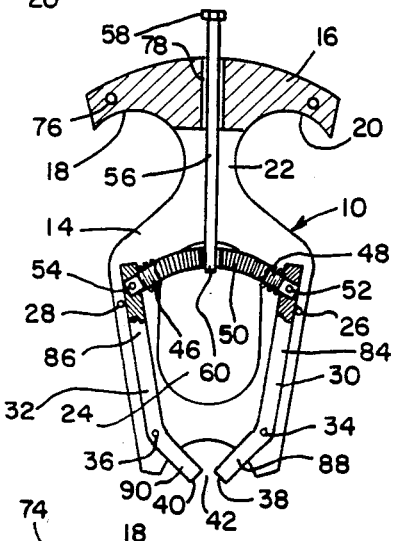
FIG. 4
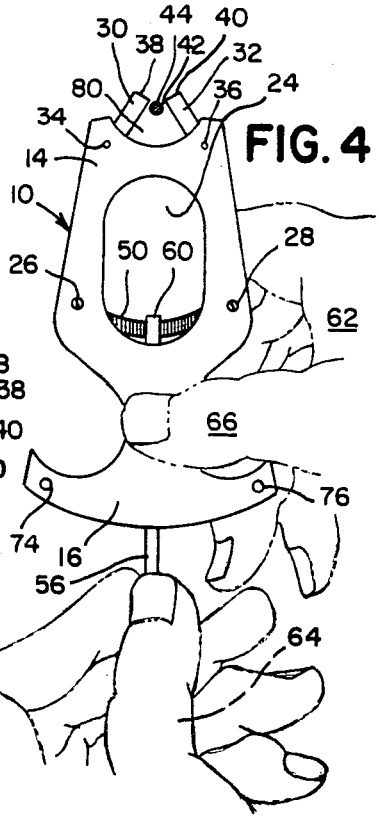
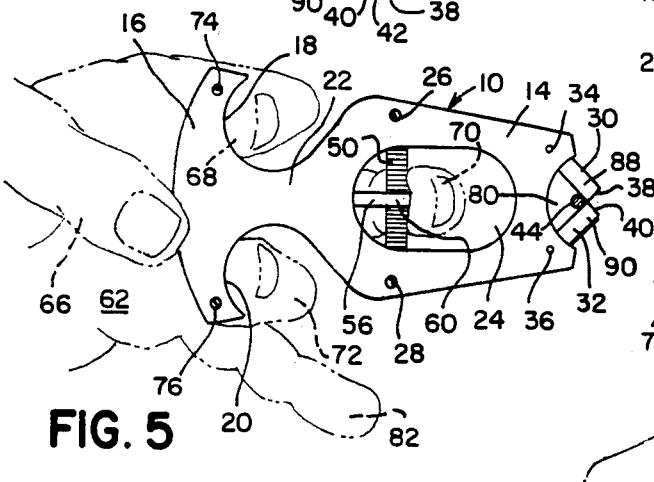
FIG. 5

BOW TRIGGER MECHANISM

FIELD OF INVENTION

The present invention relates generally to the field of archery equipment, and more particularly, is directed to a manuallly operated bow trigger mechanism for pulling and releasing the bowstring.

BACKGROUND OF THE INVENTION

Numerous types of bow trigger mechanisms have been developed by prior workers the art in an effort to permit greater utility of bows of the type suitable for use with both targets and other events such as hunting.

It has been appreciated by prior workers in the field that the distance and accuracy with which arrows can be propelled by a bow is a direct funtion of the strength of the bow. Accordingly, it is desirable to fabricate the bow of sufficient strength to maximize the force imparted upon an arrow as it is released from the bowstring. As the strength of the bow is increased, there is a direct increase in the force required to draw the bowstring prior to release of the arrow.

One of the major problems incountered in prior art constructions related to the fact that all of the forces required to draw the bowstring rearwardly were imposed directly upon two fingers of the archer, that is, the two fingers normally utilized to pull the bowstring rearwardly. Due to the relative thinness of the bow string construction and the relatively small bearing area presented by the two fingers utilized to draw the bowstring, the forces imposed upon the fingers at the areas of contact with the bowstring sometimes tended to reach unbearable pressures. Because of this, the strength of the bow construction was not limited by the strength of the archer, but rather by the pressures imposed upon the finger-bearing areas.

Accordingly, prior workers have developed numerous types of bow-drawing and triggering mechanisms in an effort to increase the area of contact with the fingers of the user and thereby permit more of the user's strength to be utilized in directly drawing the bowstring without creating such great pressures as to limit the effective application of the user's strength. Such prior constructions have included rigid frame members with jaws pivotally arranged for bowstring drawing purposes. Certain of the triggering mechanisms utilize offset construction features whereas other more recent and more successful constructions have tended to employ a center pull arrangement to provide for balanced application of the forces.

While the prior art bow trigger mechanisms have gone a long way in solving many of the archer's problems involved in drawing and accurately releasing the bowstring, many of the prior devices have tended to become quite complicated in construction and therefore costly to manufacture.

The present invention seeks to overcome many of the problems previously associated with the presently available bow trigger mechanisms and to provide a simply constructed, inexpensive and quite reliable device.

SUMMARY OF THE INVENTION

The present invention is directed to a novel bow trigger mechanism of extremely simple and reliable construction whereby manufacturing costs can be minimized without sacrifice of strength or accuracy.

The present invention includes a bow trigger body fabricated of a pair of similar spaced frame members. The frame members are formed to provide an integral, rearwardly positioned handle and a central opening for triggering purposes. A pair of bent jaws are pivotal within the area defined between the frame members and are normally biased to a closed position by a tightly wound coil spring which is transversely oriented between the rearward termini of the respective bent jaws in linear alignment. The bent jaws are pivotal within the frame members from a touching, normally locked relationship to an open, bowstring releasing relationship.

The linear coil spring is exposed within the frame opening to permit contact and rearward pulling by one of the fingers of the user. The rearward pulling action on the coil spring causes the rearward termini of the bent jaws to move slightly toward each other, thereby causing the bent jaws to pivot about respective pivot pins. The pivoting of the bent jaws defines an opening between the jaw forward ends and thus releases the bowstring. It will be appreciated that the diameter of the bowstring is quite small relative to the bow trigger mechanism and accordingly, even a slight pivotal movement of the bent jaws will be sufficient to provide a small opening between the jaw ends of sufficient width to allow passage of the bowstring.

It is therefore an object of the present invention to provide an improved bow trigger mechanism of the type set forth.

It is another object of the present invention to provide a novel bow trigger mechanism of extremely simple construction having a minimum number of operating members.

It is another object of the present invention to provide a novel bow trigger mechanism including a pair of spaced-apart, similar frame members, a pair of bent jaws pivotally arranged between the frame members, and an operating spring biased between the remote ends of the bent jaws to normally bias the jaws to their closed and locked position.

It is another object of the present invention to provide a novel bow trigger mechanism including a frame body, the body terminating rearwardly in an integral handle, a triggering opening provided in the body, a pair of jaws pivotally supported with the body, the jaws terminating rearwardly in spaced termini, the spring being noncompressible in a linear direction, the spring being adapted to be pulled to pull the bent jaw termini together, thereby pivoting the bent jaw ends apart to cause bowstring triggering.

It is another object of the present invention to provide a novel bow trigger mechanism that is simple in design, inexpensive in construction, and trouble-free when in use.

Other objects and a fuller understanding of the invention will be had by referring to the following description and claims of a preferred embodiment, taken in conjunction with the accompanying drawings, wherein like reference characters refer to similar parts throughout the several views and in which:

BRIEF DESCRIPTION OF THE DRAWINGS

FIG. 1 is a perspective view of a bow trigger mechanism constructed in accordance with the present invention.

FIG. 2 is a side elevational view of the bow trigger mechanism of FIG. 1, partially broken away to expose interior construction details and showing the operation spring in the linear, jaw-closed position.

FIG. 3 is a side elevational view similar to FIG. 2 showing the operating spring pulled to the jaw-open or bow triggering position.

FIG. 4 is a side elevational view showing the loading wire being pulled to open the jaws wide enough to span over the thickness of the bowstring.

FIG. 5 is a side elevational view showing the bow trigger mechanism of the present invention in use.

DESCRIPTION OF THE PREFERRED EMBODIMENT OF THE INVENTION

Although specific terms are used in the following description for sake of clarity, these terms are intended to refer only to the particular structure of the invention selected for illustration in the drawings, and are not intended to define or limit the scope of the invention.

Referring now to the drawings, there is illustrated in FIGS. 1, 2 and 3 a bow trigger mechanism generally designated 10, which comprises a pair of spaced-apart frame members 12, 14, which members are positioned in generally parallel planes to define an operating clearance space 13 therebetween. The frame members 12, 14 terminate rearwardly in an integral handle 16. The handle 16 is configured to form a pair of first and second finger pulls 18, 20 of configuration to comfortably receive two fingers of the user. Preferably, the handle is formed to a solid construction by inserting a plastic or other filler 21 to fill the clearance space in the handle area. The filler 21 provides additional bearing at the finger pulls 18, 20 to thereby permit the application of greater strength and force when pulling the bowstring 44 rearwardlly without causing discomfort to the archer (not shown).

Forward and rearward retaining pins 26, 28, 74, 76 transversely extend between the left and right frame members 12, 14 to space the frame members apart and to provide a sturdy construction. Preferably, the jaw pivot pins 34, 36 interconnect with the frame members 12, 14 at the forward ends thereof to provide additional support and to forwardly space the frame members apart.

As best seen in FIGS. 2 and 3, a pair of first and second bent jaws 30, 32 are pivotally retained within the operating clearance space by the respective pivot pins 34, 36. Each bent jaw 30, 32 includes a rearward, linear, operating extension 84, 86 and a forward, angularly bent bowstring contacting portion 88, 90. The pivot pins 34, 36 preferably pivotally retain the bent jaws 30, 32 at the bent junctions between the rearward operating extensions 84, 86 and the forward bowstring contacting portions 88, 90. It will be appreciated that as the rearward extensions of the bent jaws are either pulled together or biased apart, the bent jaws will be pivoted about the pivot pins 34, 36 to thereby either close the jaws by having the respective end termini 38, 40 contact as illustrated in FIG. 2, or to open the jaws to define a clearance space or opening 42 between the forward ends 38, 40 of the jaws as illustrated in FIG. 3.

Still referring to FIGS. 2 and 3, it will be seen that a pair of threaded fittings 46, 48 respectively pivotally connect to the bent jaw rearward extensions near the rearward termini thereof. The threaded fittings 46, 48 are pivotally connected to the respective bent jaws 30, 32 by employing suitable pivot pins 52, 54. In a preferred construction, the fittings 46, 48 are endwardly flattened and the bent jaws 30, 32 are similarly endwardly flattened to allow the respective flat sides of the jaws 30, 32 and threaded fittings 46, 48 to rotate relative to each other about the pivot pins 52, 54 in a known type of interconnection. The flattened ends produce a satisfactory operating pivotal connection without requiring additional space, thereby allowing the parts to easily and conveniently fit and operate within the operating clearance space 13.

The fittings 46, 48 terminate respectively inwardly in threaded ends as illustrated to provide a threaded interconnection with the operating spring 50. While a threaded interconnection between the fittings 46, 48 and the spring 50 is illustrated, it will be appreciated that other interconnections of suitable strength could be similarly used, for example a frictional inter-engagement between the parts, by employing a suitable adhesive or other known type of interconnection. The spring 50, as shown, is a tightly wound coil spring wherein adjacent turns are normally in contact to thereby render the spring construction non-compressible. Accordingly, when the spring 50 is positioned in its unbiased, natural linear alignment, the spring will be linear in configuration and thereby non-compressible. Therefore, when the spring is arranged in its linear orientation as shown in FIG. 2, the spring will bias the rearward termini of the respective bent jaws 30, 32 outwardly until the bent jaw ends 38, 40 touch to thus close and lock the jaws. In the configuration of FIG. 2, once the respective jaw ends 38, 40 contact each other, the linear arrangement and thus non-compressibility of the spring 50 will prevent any pivotal inward movement of the bent jaw rearward extensions toward each other. The linear spring arrangement will prevent any pivotal jaw movement and will thereby lock the jaws in their closed position.

As best seen in FIG. 3, a clearance, or operating opening 24 is defined in the frame members 12, 14 for triggering purposes as hereinafter more fully set forth. It will be noted that a major portion of the spring 50 is exposed within the operating opening 24 and that the operating opening extends rearwardly of the normal, unbiased, linear position of the spring. In order to open the bent jaws 30, 32, the spring 50 should be pulled rearwardly within the opening 24 to thereby assume the curved condition as illustrated. When the spring 50 is pulled to its curved position, the effective length of the spring will be shortened and respective inwardly directed forces will be applied upon the pivot pins 52, 54 by the ends of the spring 50 acting through the threaded fittings 46, 48. The inwardly directed forces thus imposed by the spring will cause the rearward termini of the bent jaws 30, 32 to pull toward each other, thereby pivoting the jaws about the respective pivot pins 34, 36.

In the illustrated embodiment, the length of the bent jaw rearward extensions 84, 86 is formed of greater length than the bent jaw forward portions or bowstring contacting extensions 88, 90 whereby a very slight inward movement of the jaw rearward extensions toward each other will cause a greater and opposite movement of the jaw forward ends 38, 40 to thus provide a sufficient clearance space of opening 42 to allow passage therethrough of the relatively small diameter bowstring 44. In order to provide a reliable and satisfactorily operating bow trigger mechanism, the coils of the operating spring 50 should be strong enough to resist any tendency to open when the spring is rearwardly pulled to the triggering position illustrated in FIG. 3. Accordingly, flexure of the spring will cause all of the rearwardly directed forces on the operating spring to be transmitted directly to the respective pivot pins 52, 54 to thus pull the rearward bent jaw extensions 84, 86 together by pivoting the jaws 30, 32 apart about the pivot pins 34, 36 for triggering purposes.

In order to utilize the bow trigger mechanism of the present invention, preferably a loading wire or string 56 is axially located through an axially aligned opening 78 which is provided through the handle filler material 21. The loading wire 56 terminates forwardly in a spring engaging loop 60 and rearwardly in an integral pull 58. The loading wire or string 56 is freely axially movable within the axially aligned opening 78 from the locked position illustrated in FIG. 2 to the loading position illustrated in FIG. 3.

As best seen in FIG. 4, in order to load the bowstring 44 for use in the bow trigger mechanism 10, the loading wire 56 can be rearwardly urged by applying rearwardly directed forces upon the loading wire pull 58. As shown, the bow trigger frame members 12, 14 can be conveniently grasped by the fingers of one hand 62, while the loading wire 56 is rearwardly urged by the fingers of the second hand 64 by grasping and pulling upon the loading wire pull 58. In the loading position, the loading wire loop 60 will pull upon the middle portion of the spring 50 to cause the spring to bend in an arc in the manner illustrated in FIGS. 3 and 4. As above set forth, the coils comprising the spring 50 will be formed strong enough to always remain in contact whereby any inwardly directed forces caused by the pulling of the spring 50 will be delivered to the pins 52, 54 through the threaded fittings 46, 48 and will not cause any opening of the coils or elongation of the spring 50.

When the spring 50 is rearwardly pulled either for loading as illustrated in FIG. 4 or triggering as in FIG. 5, the rearward pulling forces will cause the effective length of the spring to shorten. This causes pulling of the rearward termini of the bent jaw rearward extensions 84, 86 toward each other by function of the spring forces acting upon the pivot pins 52, 54. The respective inward movements of the rearward bent jaw termini will cause the bent jaws 88, 90 to pivot about the pivot pins 34, 36 to thus force the jaw ends 38, 40 sufficiently apart to define the clearance opening 42 therebetween. As illustrated, the rearward extensions 84, 86 of the bent jaws are formed to a length greater than the forward portions 88, 90 of the jaws, that is, the portions positioned forwardly of the pivot pins 34, 36. Therefore, a relatively small inward movement of the rearward termini of the bent jaws 30, 32 will cause a corresponding greater movement of the forward jaw ends 38, 40 whereby a clearance space 42 of sufficient width can be provided to allow passage of the relatively small diameter bowstring 44 therethrough and into the loading opening 80 defined between the forward portions 88, 90 of the bent jaws. Once the bowstring 44 is positioned within the loading opening 80, the rearward forces exerted on the loading wire 56 can be released to allow the spring 50 to bias to its normal linear position illustrated in FIG. 2.

After the spring 50 has been allowed to return to its linear position, any relative inward movement of the bent jaw rearward extensions 84, 86 toward each other will be absolutely prevented by the non-compressible nature of the spring 50, thereby effectively locking the jaw ends 38, 40 in their contacting and closed positions as illustrated in FIGS. 1, 2 and 5. Accordingly, after the bowstring 44 is positioned within the loading opening 80 and the spring 50 is allowed to return to its normal linear position, the bowstring will be completely locked between the bent jaws 88, 90 until the device is triggered. It will be appreciated that the bow trigger mechanism 10 may be optionally loaded by inserting a finger into the clearance or operating opening 24 and then urging the spring 50 rearwardly to manually pivot the jaws 30, 32 until a sufficient clearance opening 42 is provided for bowstring loading purposes.

In order to trigger the bow (not illustrated), the bow should be conventionally grasped by one hand 64 and the triggering device 10 should be grasped by the other hand 62 of the archer. As illustrated in FIG. 5, preferably the thumb 66 and small finger 82 are not employed in the triggering process. The second or index finger 68 is positioned in one finger pull 18 and the fourth or ring finger 72 is preferably placed in the other finger pull 20. The middle or third finger 70 is positioned within the operating opening 24 and initially is just rested upon the outer periphery of the operating spring 50. By pulling rearwardly upon the bow trigger mechanism 10 utilizing only the second finger 68 and the fourth finger 72, the bowstring 44 can be rearwardly pulled. It will be appreciated that the total bearing area provided by the handle filler 21 at the finger pulls 18, 20 will greatly exceed the bearing area which would otherwise be available where only the bowstring 44 itself contacted the fingers. Thus, the stresses involved in rearwardly pulling the bowstring will be spread over a much greater area, thereby providing considerable additional comfort to the archer (not shown) at the fingers and thus permitting the user to apply greater forces upon the bowstring 44 without the string biting into or cutting the flesh of the fingers.

With the bowstring 44 firmly locked between the forward portions of the bent jaws 30, 32, as shown in FIG. 5, and with the spring 50 in the transverse linear position as illustrated, jaws will be effectively locked about the bowstring. A rearward pull by the fingers 68, 72 of one hand will cause the bow trigger mechanism 10 to pull the bowstring 44 rearwardly by bending the bow (not illustrated) sufficiently to fully draw the arrow (also not illustrated). Once the bowstring is fully drawn and the arrow (not shown) is properly aimed, the bowstring can be quickly and simply released without jerking or other unwanted movement simply by drawing rearwardly upon the spring 50 utilizing the third or middle finger 70. As the finger 70 is rearwardly pulled, the spring 50 will be caused to bend in the manner illustrated in FIG. 3 until the jaws 30, 32 are pivoted sufficiently to provide a suitable clearance space 42 to allow passage therethrough of the bowstring 44.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claim:

1. A bow trigger mechanism comprising a frame means to support a pair of first and second jaws in operating relationship, the frame means terminating rearwardly in an operating handle, the frame means being provided with an operating opening therethrough;

a pair of first and second jaws secured to the frame means for pivotal movement of at least one of the jaws relative to the frame means, the jaws being configured to define respective rearward extensions and respective bowstring contacting portions;

biasing means positioned at least partly within the operating opening to pivot at least one of the jaws, the biasing means being movable from an initial linear configuration to a second non-linear configuration, the biasing means terminating in a first end and in a second end, the first end biasing against a rearward portion of the first jaw and the second end biasing against a portion of the rearward extension of the second jaw, the biasing means comprising a coil spring having a plurality of circular coils arranged in side-by-side juxtaposition, the adjacent coils continuously contacting each other when the biasing means is in either its linear configuration or its non-linear configuration;

whereby movement of the biasing means from the initial linear position to the second non-linear position causes at least one of the jaws to pivot relative to the frame means to cause a clearance opening between the bowstring contacting portions of the jaws for bowstring passage purposes.

2. The bow trigger mechanism of claim 1, wherein the biasing means is non-compressible and non-extendable.

3. The bow trigger mechanism of claim 2, wherein the biasing means is bendable.

4. The bow trigger mechanism of claim 1, and an axially positioned loading means, the loading means being adapted to engage the biasing means from its initial, linear configuration to its second, non-linear configuration.

5. A bow trigger mechanism comprising a frame means to support a pair of first and second jaws in operating relationship, the frame means terminating rearwardly in an operating handle, the frame means being provided with an operating opening therethrough;

a pair of first and second jaws secured to the frame means for pivotal movement of at least one of the jaws relative to the frame means, the jaws being configured to define respective rearward extensions and respective bowstring contacting portions;

biasing means positioned at least partly within the operating opening to pivot at least one of the jaws the biasing means being movable from an initial linear configuration to a second non-linear configuration, the biasing means terminating in a first end and in a second end, the first end biasing against a rearward portion of the first jaw and the second end biasing against a portion of the rearward extension of the second jaw, the biasing means comprising a coil spring having two ends and a threaded fitting interposed between each respective end of the coil spring and the respective rearward portions of the first and second jaws;

whereby movement of the biasing means from the initial linear position to the second non-linear position causes at least one of the jaws to pivot relative to the frame means to cause a clearance opening between the bowstring contacting portions of the jaws for bowstring passage purposes.

6. The bow trigger mechanism of claim 5, wherein the threaded fittings respectively threadedly engage end portions of the coil spring in a secure, non-movable relationship.

* * * * *